United States Patent [19]

Lee et al.

[11] 4,310,894

[45] Jan. 12, 1982

[54] HIGH SPEED AMBIGUITY FUNCTION EVALUATION BY OPTICAL PROCESSING

[75] Inventors: Tzuo-Chang Lee; Poohsan N. Tamura, both of Bloomington, Minn.

[73] Assignee: Honeywell Inc., Minneapolis, Minn.

[21] Appl. No.: 105,809

[22] Filed: Dec. 20, 1979

[51] Int. Cl.[3] ..... G06G 9/00

[52] U.S. Cl. ..... 364/822; 343/9 PS; 364/861

[58] Field of Search ..... 364/822, 807, 861; 343/8, 9, 9 PS; 350/162 SF

[56] References Cited

U.S. PATENT DOCUMENTS

| | | | |
|---|---|---|---|
| 3,509,565 | 4/1970 | Wilmotte | 364/822 X |
| 4,071,907 | 1/1978 | Casasent | 364/822 |
| 4,087,815 | 5/1978 | Garrison et al. | 343/9 |
| 4,099,249 | 7/1978 | Casasent | 364/822 |
| 4,123,142 | 10/1978 | Fleming | 364/822 X |

FOREIGN PATENT DOCUMENTS

| | | | |
|---|---|---|---|
| 1233007 | 5/1971 | United Kingdom | 364/822 |

OTHER PUBLICATIONS

Sprague et al.: Time Integrating Acoustooptic Correlator, Applied Optics Jan. 1976, vol. 15 No. 1, pp. 89–92.

Blanchard: A Radar Electro-Optical Processor, Symposium on Optical and Acoustical Micro-Electronics, Polytechnic Institute of New York Apr. 1974 pp. 495/509.

*Primary Examiner*—Felix D. Gruber

*Attorney, Agent, or Firm*—Omund R. Dahle

[57] ABSTRACT

An optical system which computes the ambiguity integral using one-dimensional spatial light modulators rather than the two-dimensional data masks or spatial light modulators used in the prior art is revealed. The coding is accomplished by compressing the light beam along one dimension, passing it through a one-dimensional spatial light modulator, and re-expanding the beam along the compressed dimension. The signal may be rotated to produce a linear dependence. In the preferred embodiment an acousto-optic cell commonly known as a Bragg cell is the one-dimensional spatial light modulator chosen.

10 Claims, 10 Drawing Figures

HIGH SPEED AMBIGUITY FUNCTION EVALUATION BY OPTICAL PROCESSING

BACKGROUND OF THE INVENTION

Under many circumstances an acoustic or electromagnetic signal is received from a moving source and information as to the location and velocity of the source is desirable. Examples of where this occurs are undersea surveillance and radar surveillance. A common method of representing this is on a graph known as an ambiguity plane, where distance is plotted against velocity. The relative doppler shift and time shift between two signals so received can be used to extract this data.

The ambiguity plane is prepared by evaluating the ambiguity integral which is defined as $$\chi(\omega, \tau) = \int f_1(t) f_2^*(t-\tau) e^{i\omega t} dt \quad (1)$$

In this equation $f_1(t)$ and $f_2(t)$ are the two signals being compared expressed as functions of time. The variable $\tau$ is introduced to correct for the fact that although it is expected that $f_1(t)$ and $f_2(t)$ should have a similar form, they will, in general, be shifted in time relative to each other. The function $f_2^*(t-\tau)$ is the complex conjugate of $f_2(t-\tau)$ which is the time shifted version of the signal actually received. The factor $e^{i\omega t}$ is introduced to correct for the frequency difference between $f_1(t)$ and $f_2(t)$, caused by the doppler effect. The values of $\omega$ and $\tau$ which yield a maximum value of the ambiguity integral may be used to extract information about the velocity and range of the object under surveillance.

In order to be useful for surveillance purposes the information displayed on an ambiguity surface must be as current as possible. For this reason evaluation of the integral (1) must be performed in real time. The ability of optical analog processing to process multiple channels of data rapidly in a parallel fashion has led to its acceptance as a method for ambiguity function calculations. A common procedure involves the preparation of data masks for $f_1(t)$ and $f_2^*(t-\tau)$ with t on the horizontal axis and $\tau$ on the vertical. Optical data processing means perform the multiplication and integration in equation (1) leaving an $\omega$ dependence on the horizontal axis and a $\tau$ dependence on the vertical. The graph thus produced is then searched for its greatest value, which is the maximum of the ambiguity integral.

The most important limiting factor on the speed of these prior art devices is the production of the data masks. Although the data mask for $f_1(t)$ has no $\tau$ dependence and that for $f_2^*(t-\tau)$ has only a linear $\tau$ dependence, they are normally constructed through the use of two-dimensional spatial light modulators (SLM's). Accordingly a simpler and more rapid means of coding the light beam with the data would significantly decrease the time required to produce an ambiguity plane.

SUMMARY OF THE INVENTION

The present invention provides a more rapid means of encoding the data by using a one-dimensional SLM rather than a two-dimensional one. A cylindrical lens focuses a collimated beam of light into a line. A one-dimensional SLM is placed in the focal plane along this line. In the preferred embodiment a Bragg cell is used, although other one-dimensional SLM's might be substituted. As the light passes through the SLM it is encoded with the desired data. After the light passes the focal plane it spreads in the vertical direction until it is collimated by another cylindrical lens. In this way a two-dimensional presentation with no $\tau$ dependence is produced.

The data containing a linear $\tau$ dependence may also be encoded with a one-dimensional SLM. This is accomplished by proceeding as above but rotating the lenses and the SLM around the optical axis.

A more complete understanding may be obtained by referring to the detailed description and the accompanying drawings.

DETAILED DESCRIPTION OF THE INVENTION

Figure 1:
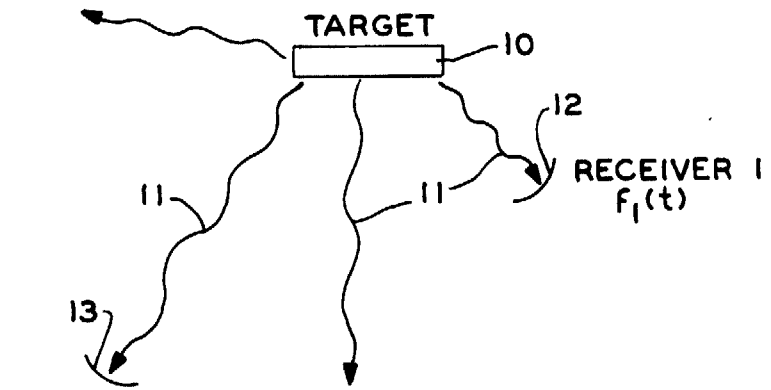
FIG. 1 is a basic scenario in which ambiguity processing is useful.

FIG. 1 shows a typical situation where ambiguity processing is used. A target 10 emits a signal, represented by arrows 11, in all directions. The signal is received by a first receiver 12 and a second receiver 13. It is clear that if the target is moving there will be a different doppler shift observed by the two receivers 12 and 13. If the receivers 12 and 13 are different distances from the target 10 the signals 11 will also arrive at different times. Therefore the signal observed by receiver 12 is of the form $$f_1(t) = \mu(t) e^{i\omega 1 t} \quad (2)$$

and the signal $f_2(t)$ observed by receiver 13 is of the form $$f_2(t) = \mu(t+t_o) e^{i\omega 2(t+t_o)} \quad (3)$$

In these expressions $\mu(t)$ may be regarded as a function modulating a carrier wave. In equation (3) $t_o$ is a constant which expresses the difference of propagation time for the signal received by the first receiver 12 and the second receiver 13. In general $t_o$ may be positive, negative or zero. If $t_o$ is positive, the signal arrives at receiver 12 before it arrives at receiver 13. If $t_o$ is negative the signal arrives at receiver 13 first. If $t_o$ is zero both receivers 12 and 13 receive the signal at the same time. The terms $e^{i\omega 1 t}$ and $e^{i\omega 2(t+t_o)}$ are carrier waves of angular frequency $\omega_1$ and $\omega_2$ respectively. The difference between $\omega_1$ and $\omega_2$ is the relative doppler shift. It is clear that the ambiguity function of equation (1) will take on a maximum value when $$\tau = t_o \text{ and } \omega = \omega - \omega_2 \quad (4)$$

Figure 1A:
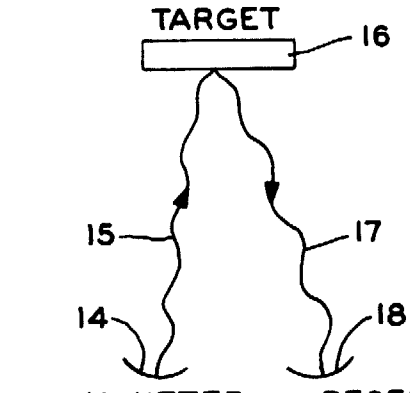
FIG. 1(A) is a variation of FIG. 1.

It should be noted that these signals could arise from radar surveillance, as shown in FIG. 1(A). In the case of radar a transmitter 14 emits a signal 15. Signal 15 is designated $f_1(t)$ and has the form shown in equation (2). Signal 15 strikes target 16 and returns as reflected signal 17. Reflected signal 17 is received by receiver 18. Reflected signal 17 is designated $f_2(t)$ and has the form of equation (3) where $t_o$ is the time elapsed between the transmission of signal 15 by transmitter 14 and the reception of reflected signal 17 by receiver 18. For radar surveillance $t_o$ will always be positive. If the target 16 is moving relative to transmitter 14 and receiver 18 $\omega_2$ will be doppler shifted from the original value of $\omega_1$. The following analysis applies equally to the situations shown in FIGS. 1 and 1(A).

An examination of equation (1) reveals a strong similarity to a Fourier transform. If $F_t$ is the Fourier transform operator which acts on the time variable, the following definition applies:

$$F_t\,[g(t,\tau)] = \int g(t,\tau)e^{i\omega t}dt \tag{5}$$

If $g(t,\tau)$ is taken to be $$g(t,\tau) = f_1(t)f_2^*(t-\tau) \tag{6}$$

it is apparent that a simple substitution will make equation (1) and equation (5) identical. Therefore the product of $f_1(t)$ and $f_2^*(t-\tau)$ of equation (6) is produced and optically Fourier transformed to evaluate equation (1).

Figure 2:
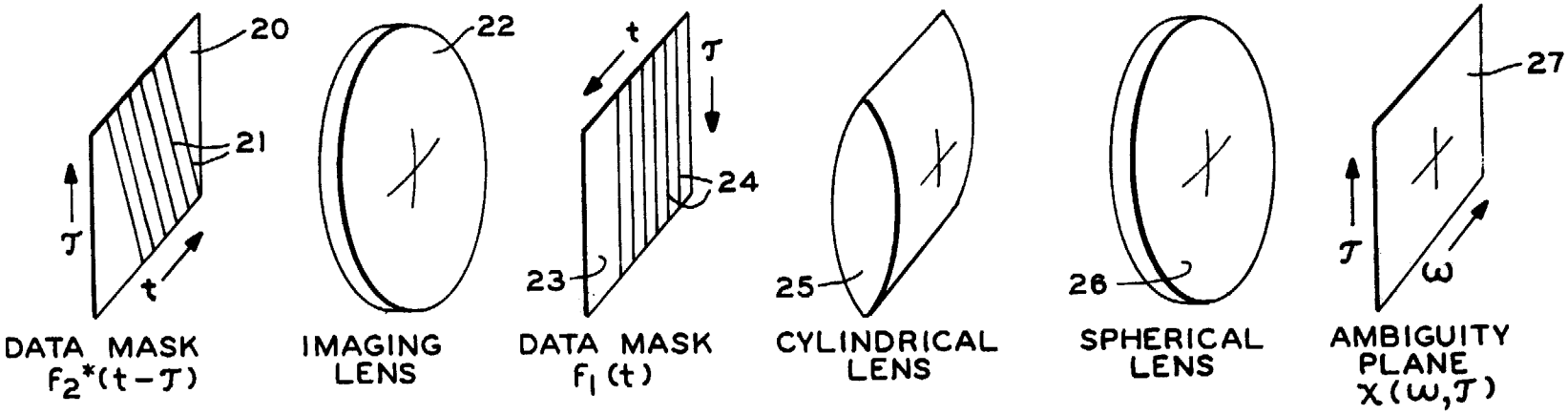
PRIOR ART FIG. 2
FIG. 2 is a typical optical ambiguity processor of the prior art.

FIG. 2 illustrates a typical system of the prior art. Coherent light from a laser, not shown, is expanded and collimated by lenses, not shown, and impinges on data mask 20. The function $f_2^*(t-\tau)$ is encoded on data mask 20 in the form of lines 21. The t variable is represented in the horizontal direction and the $\tau$ variable in the vertical. Lens 22 images data mask 20 on data mask 23. Data mask 23 is encoded with $f_1(t)$ represented by lines 24. As a result the light passing data mask 23 is encoded with the product $f_1(t)f_2^*(t-\tau)$. The light next passes through cylindrical lens 25 and spherical lens 26 and arrives at the ambiguity plane 27. The resultant image is Fourier transformed in the horizontal or t dimension and imaged in the vertical or $\tau$ dimension. Therefore the image represents the integral (1). The maximum value appears as the point of greatest light intensity, i.e. the brightest point.

Figure 3:
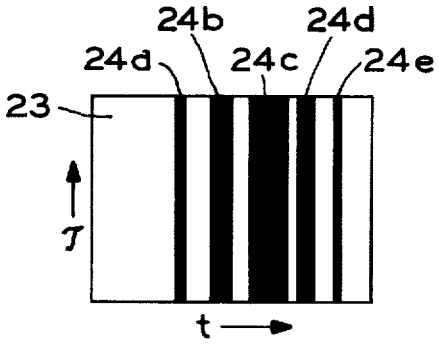
FIG. 3 is a data mask used in optical data processing to encode light beams with functions of the form f(t).

FIG. 3 shows an expanded view of data mask 23. The lines 24*a*, 24*b*, 24*c*, 24*d* and 24*e* represent the coded data $f_1(t)$. Because there is no $\tau$ dependence the value of $f_1(t)$ is the same for all values of $\tau$ associated with a particular value of t. This is apparent from the fact that the lines used to code the data run parallel to the $\tau$ axis.

Figure 4:
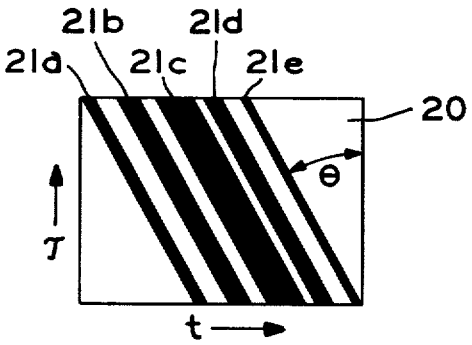
FIG. 4 is a data mask used in optical data processing to encode light beams with functions of the form $f(t-\tau)$.

FIG. 4 shows an expanded view of data mask 20. Lines 21*a*, 21*b*, 21*c*, 21*d* and 21*e* represent the coded form of the function $f_2^*(t-\tau)$. The linear $\tau$ dependence is apparent in the angle they make with the $\tau$ axis.

Data masks 20 and 23 are produced by the use of a two-dimensional spatial light modulator. Production of a mask with such a modulator requires many linear scans and is the limiting factor on the speed of the system. U.S. Pat. No. 4,017,907 to David Paul Casasent shows an improvement by substituting an electronically-addressed light modulator (EALM) tube for one of the data masks. An EALM tube is a multiple scan unit, however, with the same limitations inherent in all two-dimensional light modulators.

Figure 5:
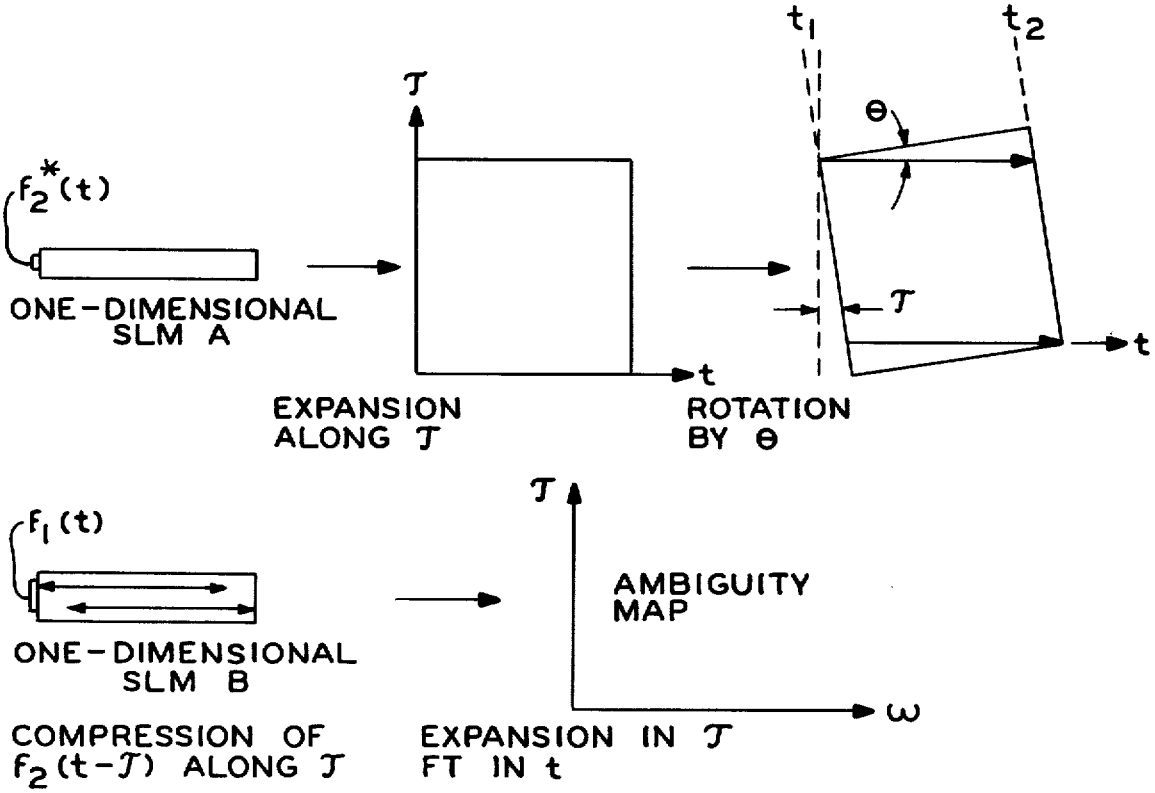
FIG. 5 illustrates the general concept of the invention.

The present invention replaces the data masks 20 and 23 with one-dimensional spatial light modulators. FIG. 5 illustrates the general concept of the invention. A signal, $f_2^*(t)$, is applied to one-dimensional SLM A. This signal is expanded along the $\tau$ axis and rotated through an angle $\theta$. The two-dimensional signal thus produced has the form $f_2^*(t-\tau)$. This signal is then compressed along the $\tau$ axis so that it may pass through one-dimensional SLM B. The signal $f_1(t)$ is applied to one-dimensional SLM B. As a result the product $f_1(t)f_2^*(t-\tau)$ is produced. Said product is again expanded in the $\tau$ dimension and Fourier transformed in the t dimension, thus producing the ambiguity surface.

Figure 6:
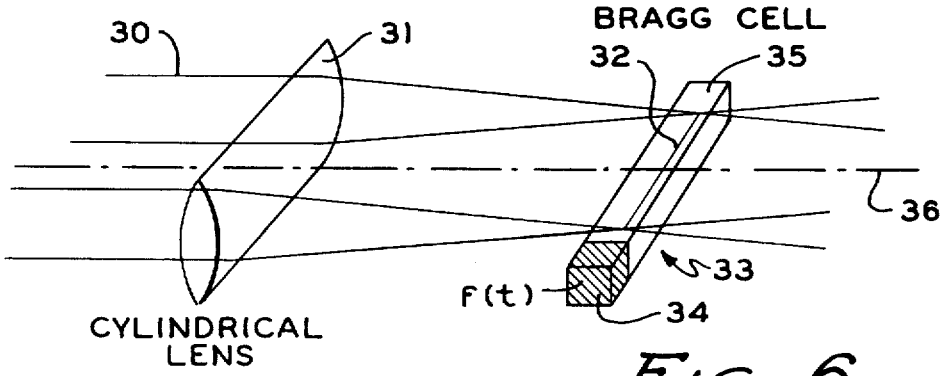
FIG. 6 is an embodiment of the present invention using a Bragg cell to encode a light beam with data.

FIG. 6 illustrates the method using acoustic-optic devices commonly known as Bragg cells. A collimated light beam 30 passes through a cylindrical lens 31, which focuses the light in the vertical direction. The light is concentrated into a single line 32 inside and parallel to the axis of the Bragg cell 33.

The Bragg cell 33 consists of two portions. These are the piezoelectric transducer 34 and the acoustic-optic cell 35. The desired function f(t), which may be $f_1(t)$ or $f_2^*(t)$, is applied to transducer 34 as an electronic signal. The transducer 34 converts said electronic signal to a mechanical wave which is applied to the acousto-optic cell 35. The mechanical wave propagates along the acousto-optic cell 35 causing variations in the index of refraction. The variations in the index of refraction cause a modulation of the light beam in accordance with the input signal, f(t).

The light beam 30 spreads in the vertical direction after passing the focal line 32. When it attains the desired width it may be recollimated by other lenses, not shown. The result is a modulated light beam similar to that which would be produced by data mask 23.

The method described produces a modulation with no $\tau$ dependence. In order to produce the linear $\tau$ dependence of data mask 20, the image must be rotated through an angle $\theta$, shown in FIG. 4. Such a rotation may be accomplished by passive optics acting on the image produced by the method discussed. A more simple method is used in the preferred embodiment, however. Referring again to FIG. 6, the cylindrical lens 31, Bragg cell 33 and recollimating optics, not shown, are rotated around the optical axis 36 by an angle $\theta$. If the input function is set equal to $f_2^*(t)$ a coding similar to that produced by data mask 20 will occur. In other words the light beam is modulated by the function $f_2^*(t-\tau)$ with t on the horizontal axis and $\tau$ on the vertical axis.

The rotation described has one other effect on the image. It produces a slight magnification of the image. The magnification factor is equal to $1/\cos\theta$. The magnification may be removed by passing the modulated light beam through a set of lenses with an appropriate demagnification factor.

Figure 7:
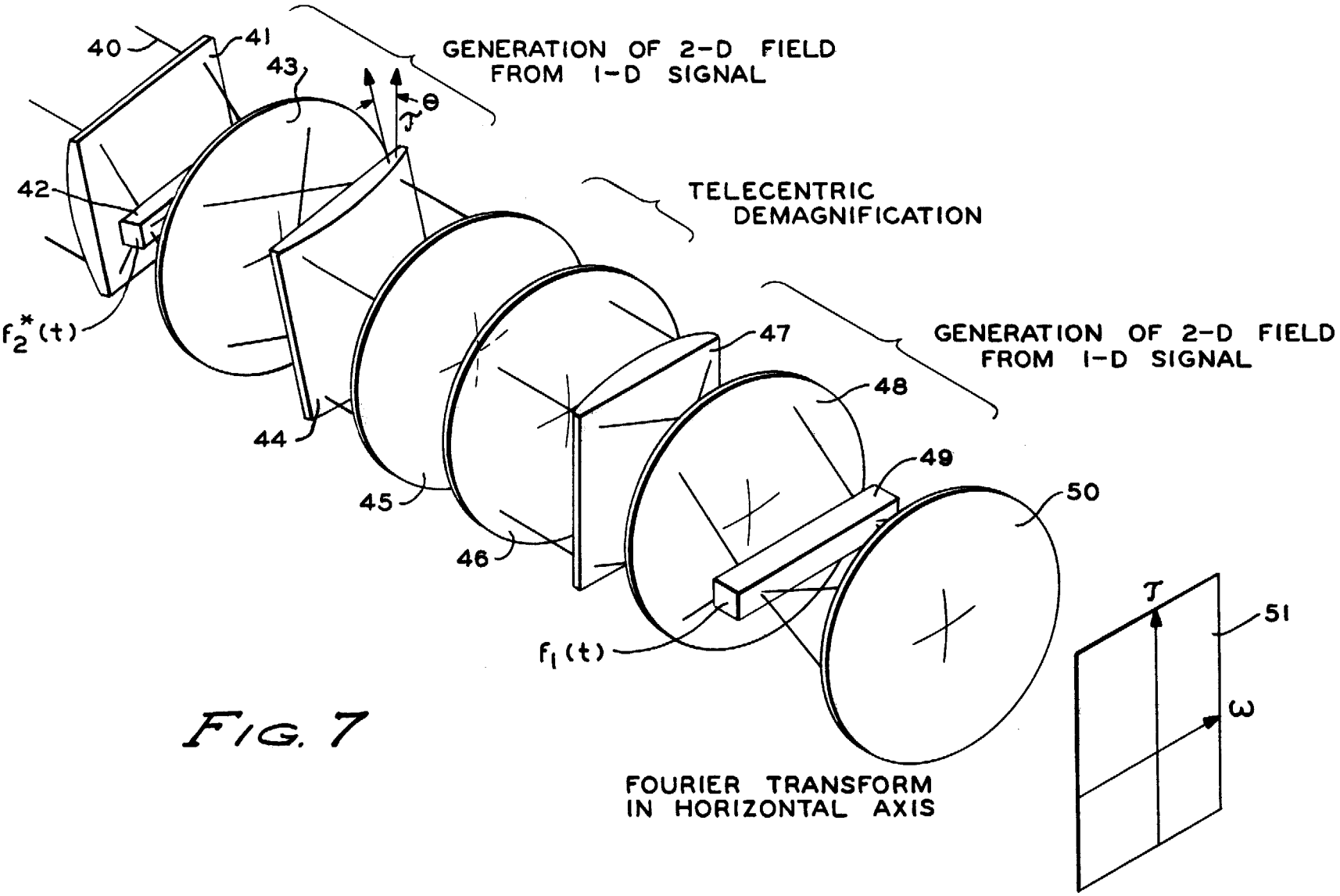
FIG. 7 is a preferred embodiment of the present invention to perform ambiguity calculations.

FIG. 7 shows a preferred embodiment for the production of an ambiguity surface. A collimated, coherent beam of light 40 is focused into a line by cylindrical lens 41. This line lies within Bragg cell 42, which modulates the light according to the input signal, $f_2^*(t)$. The modulated beam is then collimated in the vertical dimension and focused in the horizontal by spherical lens 43. Cylindrical lens 44 then collimates the beam in the horizontal dimension. Cylindrical lens 41, Bragg cell 42, and cylindrical lens 44 are all rotated around the optical axis by an angle $\theta$ with respect to the other elements of the system. Spherical lens 43 has circular symmetry around the optical axis so no such rotation is necessary.

The output of cylindrical lens 44 is a collimated beam of light modulated by the signal $f_2^*[(1/\cos\theta)(t-\tau)]$ where $1/\cos\theta$ is the magnification factor discussed previously. Lenses 45 and 46 perform a telecentric demagnification to correct for the magnification factor. Cylindrical lens 47 focuses the light in the horizontal dimension. Spherical lens 48 then collimates the beam in the horizontal dimension and focuses it in the vertical. The light is focused along a line inside the second Bragg cell 49 which modulates the light passing through it. As a result the light striking spherical lens 50 is modulated by the product $f_1(t)f_2^*(t-\tau)$. Spherical lens 50 collimates in the vertical dimension and performs a Fourier transform in the horizontal. Both dimensions are imaged onto the ambiguity plane 51. At the point on the $\omega-\tau$ plane 51 which satisfies the conditions of equation (4), the maximum value of the ambiguity integral occurs. That point will appear as a bright spot in the ambiguity plane 51.

The image detector in the ambiguity plane 51 can be any of a number of devices known in the art. For example, it may be a vidicon to provide readout on a CRT. Alternatively it could be an array of photodetectors which are arranged to determine which area of plane 51 is being illuminated by light of the greatest intensity. Other possible readout means will be readily discerned by those skilled in the art.

The embodiment illustrated in FIG. 7 may alternatively be regarded as a series of processing modules. The first module comprises cylindrical lens 41, Bragg cell 42, spherical lens 43, and cylindrical lens 44. Said first module generates the two-dimensional field $f_2^*(t-\tau)$ from the one-dimensional input signal $f_2^*(t)$. The second module comprises spherical lenses 45 and 46 and performs the telecentric demagnification. The third module comprises cylindrical lens 47, spherical lens 48, and Bragg cell 49. The function of the third module is to generate the two-dimensional field $f_1(t)f_2^*(t-\tau)$ from the signal emerging from module two and the signal $f_1(t)$. The fourth module comprises spherical lens 50. It performs the Fourier transform and imaging functions. The fifth module comprises the ambiguity plane 51 including whatever detectors are deemed appropriate for the contemplated use.

FIG. 8(A) shows a side view of an improved version of the previously discussed preferred embodiment. FIG. 8(B) shows a top view corresponding to FIG. 8(A). The dimensions shown in the drawing are in mm. and have been used in a laboratory model of the invention. These dimensions may be proportionally reduced by using lenses of shorter focal lengths.

Figure 8:
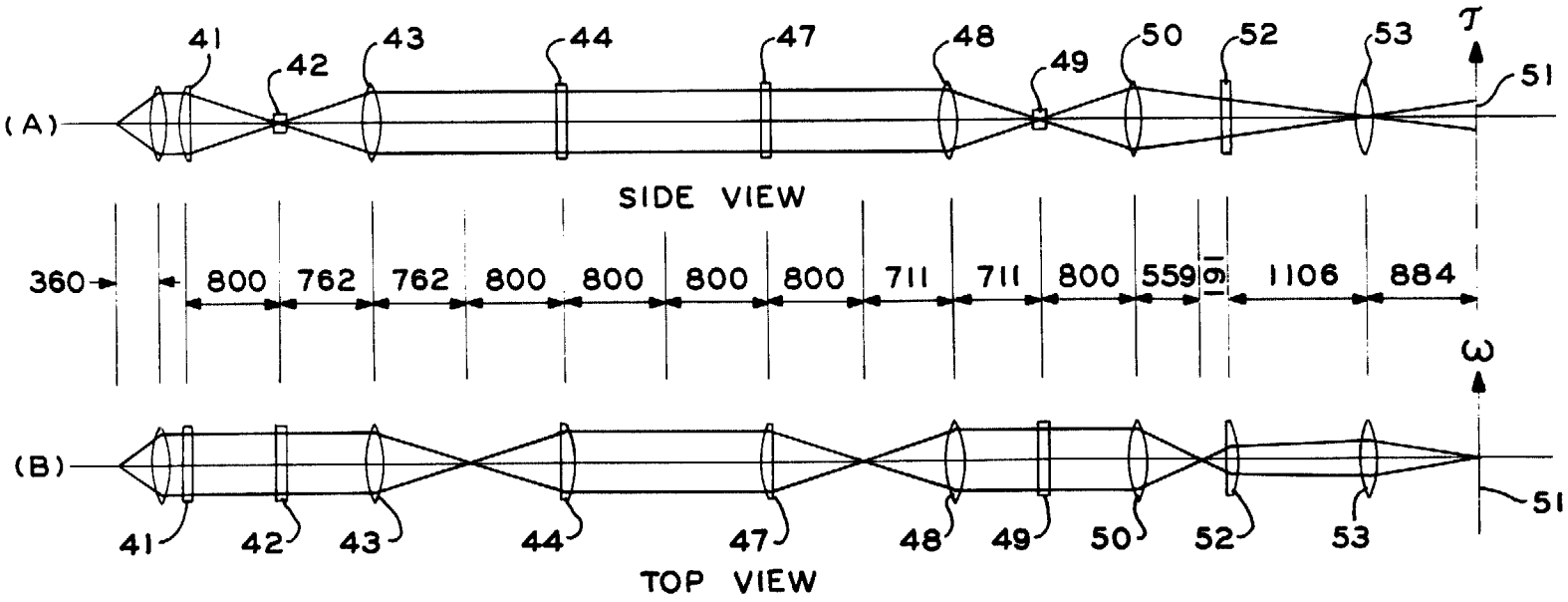
FIG. 8(A) is a side view of a modification of the embodiment shown in FIG. 7.
FIG. 8(B) is a top view of the system shown in FIG. 8(A).

The initial data encoding in the system shown in FIG. 8 occurs in a manner similar to that in FIG. 7. Although it may not be completely apparent from FIG. 8, cylindrical lenses 41 and 44 and Bragg cell 42 are rotated around the optical axis by an angle $\theta$, as shown in FIG. 7. Demagnification lenses 45 and 46 of FIG. 7 are eliminated by the choice of appropriate focal lengths for spherical lenses 43 and 48 in FIG. 8. The ratio of these focal lengths is the magnification factor and should be chosen to counteract the $1/\cos\theta$ factor previously discussed. It is apparent that the demagnification module of FIG. 7 has been eliminated, by using elements of the two data input modules to perform its function. The coding of $f_1(t)$ also proceeds analogously to the procedure used in FIG. 7. Lens 50 performs the Fourier transform in the horizontal dimension. Cylindrical lens 52 applies a slight correction in the horizontal direction so that both the horizontal and vertical dimensions may be imaged sharply in the same plane. Lens 53 produces the images in the ambiguity plane 51. In the ambiguity plane 51 an appropriate detector is used to find the point of greatest intensity as in FIG. 7. Thus it is clear that the two major changes are the elimination of lenses 45 and 46 from FIG. 7 producing a simplified optical scheme between the Bragg cells 42 and 49 and the addition of lenses 52 and 53 to provide a sharper image in the ambiguity plane 51.

The embodiments of the invention in which an exclusive property or right is claimed are defined as follows:

1. Apparatus for optically evaluating the ambiguity integral using a beam of light comprising:

a first data input module for generating an image;

a second data input module for modifying said image;

a Fourier transform and imaging module; and a detector module in the ambiguity plane, said modules defining an optical axis;

wherein at least one of the data input modules further comprises means to focus the light into a line in a focal plane; and a one-dimensional spatial light modulator lying in said focal plane along said line; and wherein one of said data input modules is rotated about the optical axis with respect to the other modules.

2. Apparatus for optically evaluating the ambiguity integral as described in claim 1 wherein both data input modules comprise:

means to focus the light beam into a line in a focal plane; and a one-dimensional spatial light modulator lying in said focal plane along said line.

3. Apparatus for optically evaluating the ambiguity integral as described in claim 1 or claim 2 wherein the one-dimensional spatial light modulators are of the type commonly known as Bragg cells.

4. Apparatus for optically evaluating the ambiguity integral as described in claim 1 or claim 2 further comprising:

a demagnification module between the first and second data input modules.

5. An apparatus for optically evaluating the ambiguity integral as described in claim 4 wherein the one-dimensional spatial light modulators are of the type commonly known as Bragg cells.

6. Apparatus for evaluation of the ambiguity integral using a collimated beam of light, propagating along an optical axis comprising:

a first data input module for generating an image comprising: a cylindrical lens to focus the light into a line in a focal plane, a one-dimensional spatial light modulator lying in said focal plane along said line, a spherical lens and a cylindrical lens for recollimating the light beam;

a second data input module for modifying said image comprising: a cylindrical lens and a spherical lens which, acting together, focus the light beam into a line in a focal plane, a one-dimensional spatial light modulator lying in said focal plane along said line;

a Fourier transform and imaging module comprising a spherical lens;

and a detection module in the ambiguity plane;

said modules defining an optical axis;

the image generated by the first data input module being rotated about said optical axis with respect to the other modules.

7. Apparatus for evaluating the ambiguity integral using a collimated beam of light as described in claim 6 further comprising a demagnification module between the first and second data input modules, said demagnification module comprising two spherical lenses.

8. Apparatus for evaluating the ambiguity integral using a collimated beam of light as described in claim 6 or claim 7 wherein the one-dimensional spatial light modulators are of the type commonly known as Bragg cells.

9. Apparatus for evaluating the ambiguity integral using a collimated beam of light as described in claim 6 wherein the Fourier transform module further comprises a cylindrical lens and a second spherical lens.

10. Apparatus for evaluating the ambiguity integral using a collimated beam of light as described in claim 9 wherein the one-dimensional spatial light modulators are of the type commonly known as Bragg cells.

* * * * *